United States Patent [19]

Miwa

[11] Patent Number: 4,877,968

[45] Date of Patent: Oct. 31, 1989

[54] THIN LAYER EL PANEL

[75] Inventor: Kazunori Miwa, Yokohama, Japan

[73] Assignee: Nissan Motor Co., Ltd., Yokohama, Japan

[21] Appl. No.: 130,191

[22] Filed: Dec. 8, 1987

[30] Foreign Application Priority Data

Dec. 9, 1986 [JP] Japan ..... 61-291522

[51] Int. Cl.[4] ..... H01J 1/62

[52] U.S. Cl. ..... 250/484.1; 428/917; 428/690

[58] Field of Search ..... 250/484.1 R; 428/917, 428/690

[56] References Cited

U.S. PATENT DOCUMENTS

| | | | |
|---|---|---|---|
| 2,834,903 | 5/1958 | Roberts | 250/484.1 R |
| 4,590,128 | 5/1986 | Kawai | 428/917 |
| 4,613,546 | 9/1986 | Kuwata et al. | 428/917 |
| 4,664,985 | 5/1987 | Matsuoka et al. | 428/917 |
| 4,670,355 | 6/1986 | Matsudaira | 357/17 |
| 4,708,914 | 11/1987 | Kamijo | 428/917 |
| 4,708,943 | 11/1987 | Hsieh et al. | 343/872 |

FOREIGN PATENT DOCUMENTS 52-129296 10/1977 Japan .

*Primary Examiner*—Janice A. Howell
*Assistant Examiner*—William F. Rauchholz
*Attorney, Agent, or Firm*—Foley & Lardner, Schwartz, Jeffery, Schwaab, Mack, Blumenthal & Evans

[57] ABSTRACT

The dielectric layers which sandwich the fluorescent layer therebetween are formed of amorphous SiYON or SiYAl ON. These layers exhibit improved adhesive characteristics and attenuate interlayer separation during production and under prolonged voltage impression.

11 Claims, 2 Drawing Sheets

THIN LAYER EL PANEL

BACKGROUND OF THE INVENTION

1. Field of the Invention

The present invention relates to a thin layer EL panel and more specifically to a EL panel which is suited for use in displays and the like which exhibits as long working life and can be readily manufactured.

2. Description of the Prior Art

FIG. 1 shows a previously proposed thin layer EL panel suitable for the above mentioned purpose. This arrangement includes a glass substrate 1, a transparent electrode 2 formed of $In_2O_3$ or $SnO_2$, a dielectric layer 3 formed of $Si_3N_4$ or $Ta_2O_5$, a layer 4 of fluorescent material such as ZnS doped with Mn, a second dielectric layer 5 and rear surface electrodes 6. The latter mentioned electrodes 6 are formed by sputtering or vacuum depositing aluminum or similar conductor and subsequently photoetching the metal layer to produce the required patterning.

When a voltage is suitably impressed across the electrodes 2 and 6, portions of the fluorescent layer 4 can be induced to illuminate in a manner which produces an image.

With this arrangement, in order to prevent the infiltration of water and impurities, it is neccessary to use $Si_3N_4$ dielectric layers 3 and 5 which exhibit a high blocking effect. However, layers made of $Si_3N_4$ tend to induce internal stress within the device and further exhibit poor adhesive properties with respect to the other layers defining the panel. This tends to lead to "peeling-off" or interlayer separation during the manufacture of the same. This phenomenon tends to be further promoted when voltages are impressed on the panel for prolonged periods and leads to the situation wherein the panel is no longer of practical use for display purposes.

One attempt to overcome this problem is disclosed in JP-A-52-129296 (1977) wherein it is proposed to form the dielectric layers of $Si_3N_4$ mixed with a controlled amount of $SiO_2$. However, this measure while improving the adhesion characteristics of the layers, suffers from the drawback that the dielectric characteristics of the layer decrease with the increase in $SiO_2$ concentration to the degree that sufficient $SiO_2$ cannot be added in order to adequately solve the interlayer separation problem.

SUMMARY OF THE INVENTION

It is an object of the present invention to provide a thin layer type EL panel which obviates the interlayer separation and internal stress problems to the degree that efficient production and a long working life of the same is ensured.

In brief, the above object is achieved by an arrangement wherein the dielectric layers which sandwich the fluorescent layer therebetween are formed of amorphous SiYON (silicon yttrium oxynitride) or SiYAl ON (silicon yttrium aluminum oxynitride). These layers exhibit improved adhesive characteristics and attenuate interlayer separation during production and under prolonged voltage impression.

More specifically, the present invention takes the form of an electroluminescent panel comprising: a substrate; a transparent electrode formed on the substrate; a first dielectric layer, the first dielectric layer being formed of one of silicon yttrium oxynitride and silicon yttrium aluminum oxynitride; a fluorescent layer; a second dielectric layer, the second dielectric layer being formed of one of silicon yttrium oxynitride and silicon yttrium aluminum oxynitride; and rear surface electrodes formed on the second dielectric layer.

DETAILED DESCRIPTION OF THE PREFERRED EMBODIMENTS

Figure 1:
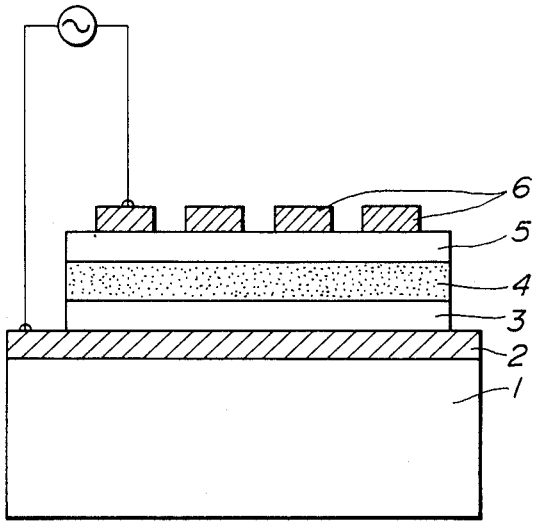
FIG. 1 (PRIOR ART)
FIG. 1 shows one of the prior art arrangements discussed in the opening paragraphs of the instant disclosure.
Figure 2:
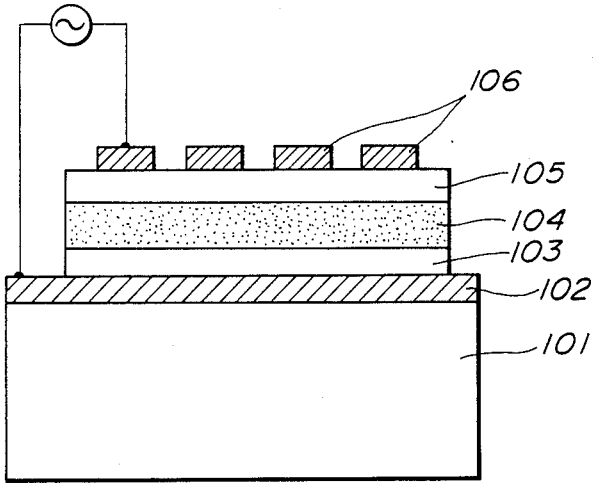
FIG. 2 is a sectional view showing a first embodiment of the present invention.

FIG. 2 of the drawings shows a first embodiment of the present invention. In this arrangement the glass substrate 101 and the transparent electrode 102 are formed in essentially the same manner as the prior art arrangement shown in FIG. 1. On top of this a first dielectric layer 103 of SiYON (Silicon Yttrium Oxynitride) is deposited by sputtering a prepared target (or the like process) with a mixture of powdered $Si_3N_4$and $Y_2O_3$. A fluorescent layer 104 of ZnS doped with Mn is then formed. Following this, a second dielectric layer 105 of SiYON and the rear surface electrodes (Al) 106 are sequentially formed. The previously mentioned transparent electrode 102 and the rear surface electrodes 106 are suitably patterned using a photoetching technique is a similar manner to that employed in the FIG. 1 prior art.

With the above mentioned panel construction, in order to improve the crystalline structure and the resulting brightness of the illumination produced by the fluorescent panel, it is necessary to heat treat at about 500° C.. By way of example, one part of the process of forming the instant embodiment is as follows:

1. clean glass substrate;
2. apply and pattern transparent electrode;
3. apply first dielectric layer;
4. apply fluorescent layer;
5. anneal at 500° C. for one hour With the prior art constructions as the $Si_3N_4$ layer exhibits poor adhesion to the other layers heat treatment techniques sometimes tend to induce interlayer separation. Interlayer stress is given by the following equation:

$$Sigma_f=(alpha_f-alpha_s)E_f\times Delta\ T/(1-upsilon_f+sigma_{in}) \quad (1)$$

wherein:

alpha: denotes thermal expansion coefficient;

E: denotes Young's modulus;

upsilon: denotes Poison's ratio;

Delta T: denotes the layer formation time to temperature differential;

f, s: denote the layer and the substrate respectively; and $sigma_{in}$: denotes the actual internal stress which develops including the stress caused by the change in volume which the layer undergoes during its formation or during the annealing process.

The following table sets forth the thermal expansion and elasticity coefficients of the layers used in the prior art arrangement and of materials used in the present invention.

TABLE

| MATERIAL | THERM. EXP. COEFF. ($10^{-6}$/°C.) | YOUNGS MOD. | POISON'S RATIO | INDUCTION RATIO |
|---|---|---|---|---|
| ZnS | 6.2 | 6 | 0.02 | — |
| glass (borosilicate glass) | 5.0 | 6.9 | | — |
| $Si_3N_4$ | 2.5–3 | 37 | 0.2 | 7 |
| $Y_2O_3$ | 8 | −10 | −0.2 | 12 |
| $SiO_2$ | 0.5 | 7.4 | 0.16 | 3.5 |
| $Al_2O_3$ | 8.4 | 46 | −0.2 | 10 |

As is clear from the above table, ZnS and the glass of the substrate have expansion coefficients which exhibit similar values but which are approximately twice that of $Si_3N_4$. In addition $Si_3N_4$ exhibits a high Young's modulus and therefore is prone to develop a high internal stress.

Experiments have revealed that the $Si_3N_4$, $Y_2O_3$, $SiO_2$, $Al_2O_3$ compounds can be relatively easily be used to form amorphous layers.

The mixture of $Si_3N_4$ and $Y_2O_3$ exhibits particular interprocess thermal stress stability and thus attenuates interlayer separation. Further, this mixture can be controlled in a manner to exhibit a coefficient of expansion close to that of the glass substrate. The experiments further revealed that level of oxidized matter which can be introduced contributes to improved adhesion characteristics.

With the present invention, the use of $Si_3N_4$ and $Y_2O_3$ renders it possible to form an amorphous layer which exhibits a coefficient of expansion which is close to that of the glass substrate.

However, with the present invention if a voltage is impressed on the panel for prolonged periods of time, it is possible that interlayer separation will occur and result in the loss of illuminative power of the panel. This is deemed to be caused by external moisture undergoing electrolytic decomposition which results in the formation of gas the pressure of which induces interlayer separation despite the improved adhesive properties.

Figure 3:
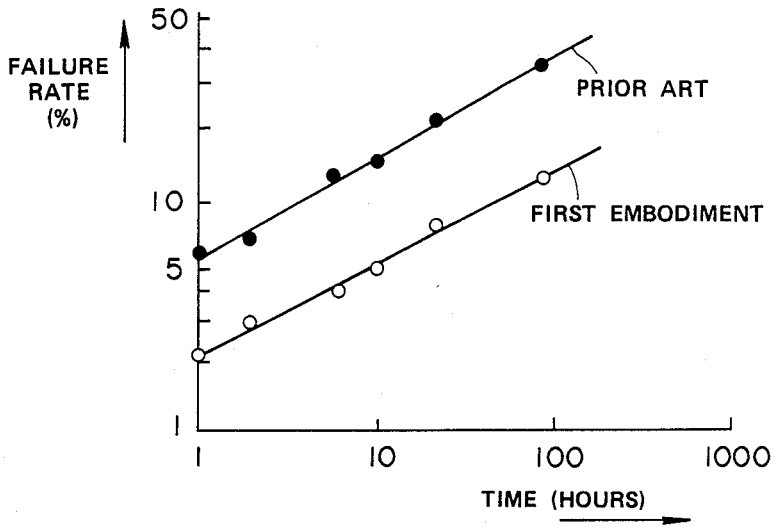
FIG. 3 is a graph which shows in terms of malfunction ratio and time, the improvement achieved with the invention over the prior art.

FIG. 3 shows the results of tests conducted under elevated temperature and humidity conditions (80° C., 90% RH). The rate of failure with a predetermined voltage impressed was determined for each of the first embodiment of invention and the prior art arrangement. As shown, the failure rate of the prior art was much higher than with the embodiment shown in FIG. 2. The reason for this is attributed to the improved adhesion between the SiYON and fluorescent layers. In this case if the Si to Y ratio Y/Si (mole ratio) is greater than or equal to 0.6 then the blocking of Na and moisture is notably reduced. Accordingly, a mole ratio of $0.01 \leqq Y/Si \leqq 0.6$ is deemed more appropriate.

By mixing some $Al_2O_3$ in the SiYON the adhesive properties can be improved without loss of any blocking effect. In this instance a Al mole ratio of 0.1 to 10% is deemed appropriate. Further, this type of SiYAl ON layer can be formed by target sputtering a mixture of powdered $Si_3N_4$, $Y_2O_3$ and $Al_2O_3$ and used to form the first dielectric layer 103.

Figure 4:
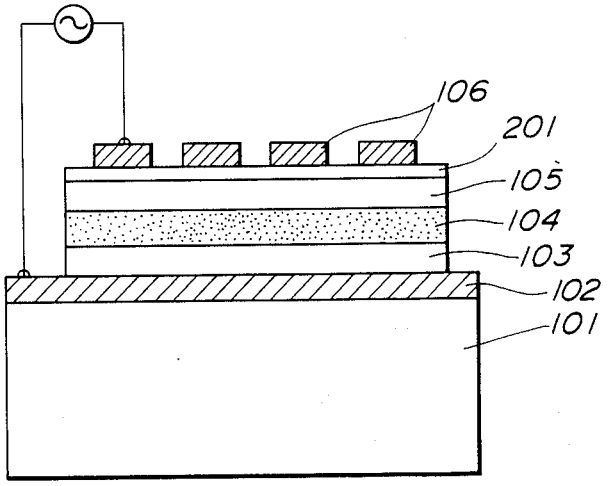
FIG. 4 is a sectional view showing a second embodiment of the present invention.

FIG. 4 shows a second embodiment of the present invention. This embodiment is essentially similar to the first one but features an additional dielectric layer 201 which is disposed between layer 105 and the electrodes 106 and which exhibits a high resistivity ratio. This layer can take the form of amorphous $SiO_2$or $Al_2O_3$, $Si_3N_4$ which exhibits a stable high resistance ratio. A thickness of 100Å to 3000Å is deemed appropriate.

With this embodiment, when a voltage is impressed across the electrodes 102 and 106, the current flow, as watt consumption, is suppressed, thereby prolonging the working life of the panel.

What is claimed is:

1. An electroluminescent panel comprising:
- a substrate;
- a transparent electrode disposed on said substrate;
- a first dielectric layer disposed on said transparent electrode, said first dielectric layer being comprised of one of silicon yttrium oxynitride and silicon yttrium aluminum oxynitride;
- a fluorescent layer;
- a second dielectric layer disposed on said fluorescent layer, said second dielectric layer being comprised of one of silicon yttrium oxynitride and silicon yttrium aluminum oxynitride; and
- rear surface electrodes disposed on said second dielectric layer.

2. An electroluminescent panel as claimed in claim 1 wherein said first dielectric layer is amorphous.

3. An electroluminescent panel as claimed in claim 1 wherein said second dielectric layer is amorphous.

4. An electroluminescent panel as claimed in 1 wherein said first dielectric layer is formed by sputtering a mixture of powdered silicon nitride and powdered yttrium oxide.

5. An electroluminescent panel as claimed in 1 wherein said second dielectric layer is formed by sputtering a mixture of powdered silicon nitride and powdered yttrium oxide.

6. An electroluminescent panel as claimed in claim 1 wherein said first dielectric layer is formed by sputtering a mixture of powdered silicon oxide, powdered yttrium oxide and powdered aluminum oxide.

7. An electroluminescent panel as claimed in claim 1 wherein said second dielectric layer is formed by sputtering a mixture of powdered silicon oxide, powdered yttrium oxide and powdered aluminum oxide.

8. An electroluminescent panel comprising:
- a substrate;
- a transparent electrode disposed on said substrate;
- a first dielectric layer disposed on said transparent electrode, said first dielectric layer being comprised of one of silicon yttrium oxynitride and silicon yttrium aluminum oxynitride;
- a fluorescent layer;
- a second dielectric layer disposed on said fluorescent layer, said second dielectric layer being comprised of one of silicon yttrium oxynitride and silicon yttrium aluminum oxynitride;
- a third dielectric layer disposed on said second dielectric layer; and
- rear surface electrodes disposed on said third dielectric layer.

9. An electroluminescent panel as claimed in claim 8 wherein said third dielectric panel is comprised of one of silicon oxide and aluminum oxide and silicon nitride.

10. An electroluminescent panel as claimed in claim 9 wherein said third dielectric layer has a thickness of 100 to 3000Å.

11. An electroluminescent panel as claimed in claim 8 wherein said third dielectric layer is amorphous.

* * * * *